US008950151B2

(12) United States Patent
Strickland et al.

(10) Patent No.: US 8,950,151 B2
(45) Date of Patent: Feb. 10, 2015

(54) ADJUSTABLE FLOOR TO WALL CONNECTORS FOR USE WITH BOTTOM CHORD AND WEB BEARING JOISTS

(75) Inventors: Michael R. Strickland, Richmond Hill (CA); Douglas M. Fox, Kitchener (CA)

(73) Assignee: Ispan Systems LP, Princeton, ON (CA)

( * ) Notice: Subject to any disclaimer, the term of this patent is extended or adjusted under 35 U.S.C. 154(b) by 133 days.

(21) Appl. No.: 13/062,900

(22) PCT Filed: Sep. 8, 2009

(86) PCT No.: PCT/CA2009/001247

§ 371 (c)(1),
(2), (4) Date: May 27, 2011

(87) PCT Pub. No.: WO2010/025569

PCT Pub. Date: Mar. 11, 2010

(65) Prior Publication Data

US 2011/0219720 A1 Sep. 15, 2011

Related U.S. Application Data

(60) Provisional application No. 61/136,476, filed on Sep. 8, 2008.

(51) Int. Cl.
*E04C 3/02* (2006.01)
*E04B 1/32* (2006.01)
(Continued)

(52) U.S. Cl.
CPC ... *E04B 5/10* (2013.01); *E04B 1/24* (2013.01); *E04B 9/00* (2013.01);
(Continued)

(58) Field of Classification Search
USPC ..... 52/702, 712, 713, 655.1, 696
See application file for complete search history.

(56) References Cited

U.S. PATENT DOCUMENTS 827,268 A 7/1906 Stieper
1,360,720 A 11/1920 Brown et al.
(Continued)

FOREIGN PATENT DOCUMENTS

AU 47479/79 12/1980
AU 540590 1/1985
(Continued)

OTHER PUBLICATIONS

International Search Report for PCT/CA2010/001750, mailed Feb. 21, 2011.
(Continued)

*Primary Examiner* — Elizabeth A Plummer
(74) *Attorney, Agent, or Firm* — Hill & Schumacher

(57) ABSTRACT

The present invention is a light steel framed metal joist including an adjustable connector fastened to the joist web that allows one to adjust the length and angle of the joist when attaching to floor and wall systems. The adjustment allows one to install end connectors onto the joists prior to installation while retaining flexibility of orientation during construction. The joist functions in both web bearing and bottom chord bearing configurations. A flat plate distributing member allows one to design a floor system without having to coordinate the positioning of the joist with wall studs. Angle or U shaped members can be fastened to the lower portion of the flat plate distribution member to support joists during construction. The invention further provides a seamless fire stopping system with consideration for acoustic dampening.

18 Claims, 14 Drawing Sheets

(a)

(b)

(c)

(51) Int. Cl.

| | |
|---|---|
| ***E04B 5/10*** | (2006.01) |
| ***E04B 1/24*** | (2006.01) |
| ***E04B 9/00*** | (2006.01) |
| *E04C 3/04* | (2006.01) |

(52) U.S. Cl.

CPC *E04B 2001/2415* (2013.01); *E04B 2001/2439* (2013.01); *E04B 2001/2448* (2013.01); *E04B 2001/2466* (2013.01); *E04B 2001/2481* (2013.01); *E04B 2001/2484* (2013.01); *E04C 2003/0434* (2013.01); *E04C 2003/0452* (2013.01)

USPC ..... 52/702; 52/713; 52/655.1; 52/696

(56) References Cited

U.S. PATENT DOCUMENTS

| | | | |
|---|---|---|---|
| 1,622,559 | A | 3/1927 | Zabriskie |
| 1,915,424 | A | 6/1933 | Kerr |
| 1,918,345 | A | 7/1933 | McHose |
| 1,974,730 | A | 9/1934 | Zollinger |
| 1,983,632 | A | 12/1934 | Miller |
| 2,088,781 | A | 8/1937 | Folsom |
| 2,108,373 | A | 2/1938 | Greulich |
| 2,169,253 | A | 8/1939 | Kotrbaty |
| 2,194,810 | A | 3/1940 | Reiner |
| 2,246,215 | A | 6/1941 | Nagin et al. |
| 2,256,812 | A | 9/1941 | Miller |
| 2,457,250 | A | 12/1948 | Macomber |
| 2,514,607 | A | 7/1950 | McLean |
| 2,624,430 | A | 1/1953 | Macomber |
| 2,630,890 | A | 3/1953 | Macomber |
| 2,630,899 | A | 3/1953 | Macomber |
| 2,662,272 | A | 12/1953 | Macomber |
| 2,860,743 | A | 11/1958 | Cliff |
| 2,864,471 | A | 12/1958 | Williams |
| 3,158,731 | A | 11/1964 | Cape |
| 3,221,467 | A | 12/1965 | Henkels |
| 3,288,977 | A | 11/1966 | Keller |
| 3,349,535 | A | 10/1967 | Balinski |
| 3,367,080 | A | 2/1968 | McClelland |
| 3,381,439 | A | 5/1968 | Thulin, Jr. |
| 3,483,665 | A | 12/1969 | Miller |
| 3,487,861 | A | 1/1970 | Fahrenbach |
| 3,626,567 | A | 12/1971 | Michelson et al. |
| 3,639,962 | A | 2/1972 | Gooder |
| 3,641,303 | A | 2/1972 | Collins |
| 3,818,083 | A | 6/1974 | Butts et al. |
| 3,942,297 | A | 3/1976 | Kitagawa |
| 3,945,168 | A | 3/1976 | Butts et al. |
| 3,945,741 | A | 3/1976 | Wendt |
| 3,979,868 | A | 9/1976 | Butts et al. |
| 4,041,664 | A | 8/1977 | Davis, Jr. |
| 4,056,908 | A | 11/1977 | McManus |
| 4,122,647 | A | 10/1978 | Kovar |
| 4,151,694 | A | 5/1979 | Sriberg et al. |
| 4,159,604 | A | 7/1979 | Burrell |
| 4,189,883 | A | 2/1980 | McManus |
| 4,207,719 | A | 6/1980 | Knowles |
| 4,281,497 | A | 8/1981 | Luotonen et al. |
| 4,385,476 | A | 5/1983 | Slager |
| 4,409,771 | A | 10/1983 | Lowe |
| 4,421,969 | A | 12/1983 | Tanenbaum |
| 4,432,178 | A | 2/1984 | Taft |
| 4,441,292 | A | 4/1984 | Ericsson |
| 4,454,695 | A | 6/1984 | Person |
| 4,476,662 | A | 10/1984 | Fisher |
| 4,490,958 | A | 1/1985 | Lowe |
| 4,548,014 | A | 10/1985 | Knowles |
| 4,549,381 | A | 10/1985 | Holtz |
| 4,560,301 | A | 12/1985 | Gilb |
| 4,566,240 | A | 1/1986 | Schilger |
| 4,569,177 | A | 2/1986 | Ottinger |
| 4,592,184 | A | 6/1986 | Person et al. |
| 4,688,358 | A | 8/1987 | Madray |
| 4,691,494 | A | 9/1987 | Gwynne |
| 4,702,059 | A | 10/1987 | Holtz |
| 4,715,155 | A | 12/1987 | Holtz |
| 4,720,957 | A | 1/1988 | Madray |
| 4,729,201 | A | 3/1988 | Laurus et al. |
| 4,741,138 | A | 5/1988 | Rongoe, Jr. |
| 4,793,113 | A | 12/1988 | Bodnar |
| 4,836,436 | A | 6/1989 | Hannah |
| 4,837,994 | A | 6/1989 | Stohs |
| 4,845,908 | A | 7/1989 | Stohs |
| 4,887,406 | A | 12/1989 | Saia |
| 4,937,997 | A | 7/1990 | Thomas, Jr. et al. |
| 4,937,998 | A | 7/1990 | Goldberg |
| 4,947,612 | A | 8/1990 | Taylor et al. |
| 4,982,545 | A | 1/1991 | Stromback |
| 4,986,051 | A | 1/1991 | Meyer et al. |
| 5,004,369 | A | 4/1991 | Young |
| 5,146,726 | A | 9/1992 | Ellison, Jr. |
| 5,207,045 | A | 5/1993 | Bodnar |
| 5,214,900 | A | 6/1993 | Folkerts |
| 5,220,761 | A | 6/1993 | Selby |
| 5,230,190 | A | 7/1993 | Schuette |
| 5,240,342 | A | 8/1993 | Kress, Jr. |
| 5,301,486 | A | 4/1994 | Taylor |
| 5,373,675 | A | 12/1994 | Ellison, Jr. |
| 5,417,028 | A | 5/1995 | Meyer |
| 5,476,704 | A | 12/1995 | Kohler |
| 5,499,480 | A | 3/1996 | Bass |
| 5,527,625 | A | 6/1996 | Bodnar |
| 5,544,464 | A | 8/1996 | Dutil |
| 5,546,716 | A | 8/1996 | Broxterman et al. |
| 5,553,437 | A | 9/1996 | Navon |
| 5,625,995 | A | 5/1997 | Martin |
| 5,669,197 | A | 9/1997 | Bodnar |
| 5,687,538 | A | 11/1997 | Frobosilo et al. |
| 5,761,873 | A | 6/1998 | Slater |
| 5,771,653 | A | 6/1998 | Dolati et al. |
| 5,842,318 | A | 12/1998 | Bass et al. |
| 5,865,008 | A | 2/1999 | Larson |
| 5,875,605 | A | 3/1999 | Rudd |
| 5,895,534 | A | 4/1999 | Daley et al. |
| 5,927,036 | A | 7/1999 | Matthews et al. |
| 5,937,608 | A | 8/1999 | Kucirka |
| 5,941,035 | A | 8/1999 | Purse |
| 6,073,414 | A | 6/2000 | Garris et al. |
| 6,131,362 | A | 10/2000 | Buecker |
| 6,170,217 | B1 | 1/2001 | Meyer |
| 6,176,053 | B1 * | 1/2001 | St. Germain ..... 52/232 |
| 6,240,682 | B1 * | 6/2001 | James et al. ..... 52/90.2 |
| 6,254,306 | B1 | 7/2001 | Williams |
| 6,263,634 | B1 | 7/2001 | Bodnar et al. |
| 6,301,854 | B1 | 10/2001 | Daudet et al. |
| 6,301,857 | B1 | 10/2001 | Vrana |
| 6,415,577 | B1 | 7/2002 | Curtis |
| 6,418,694 | B1 | 7/2002 | Daudet et al. |
| 6,436,552 | B1 | 8/2002 | Walker et al. |
| 6,457,292 | B1 | 10/2002 | Vrana |
| 6,484,464 | B1 | 11/2002 | Ochoa |
| 6,519,908 | B1 | 2/2003 | Masterson et al. |
| 6,571,527 | B1 | 6/2003 | Rattini |
| 6,612,087 | B2 * | 9/2003 | diGirolamo et al. ..... 52/712 |
| 6,634,153 | B1 | 10/2003 | Peterson |
| 6,658,809 | B2 | 12/2003 | Collins |
| 6,662,517 | B1 | 12/2003 | Thompson |
| 6,708,459 | B2 | 3/2004 | Bodnar |
| 6,761,005 | B1 | 7/2004 | Daudet et al. |
| 6,799,406 | B2 | 10/2004 | Gosselin et al. |
| 6,799,407 | B2 | 10/2004 | Saldana |
| 6,843,036 | B2 | 1/2005 | Stewart, III |
| 6,874,294 | B2 | 4/2005 | Masterson et al. |
| 6,964,140 | B2 | 11/2005 | Walker et al. |
| 7,086,208 | B2 | 8/2006 | Masterson et al. |
| 7,093,401 | B2 | 8/2006 | Collins |
| 7,104,024 | B1 * | 9/2006 | diGirolamo et al. ..... 52/710 |
| 7,107,730 | B2 | 9/2006 | Park |
| 7,231,746 | B2 | 6/2007 | Bodnar |
| 7,240,463 | B2 | 7/2007 | Masterson et al. |
| 7,409,804 | B2 | 8/2008 | Moody et al. |
| 7,546,714 | B2 | 6/2009 | Masterson et al. |

(56) References Cited

U.S. PATENT DOCUMENTS

| | | | | |
|---|---|---|---|---|
| 8,555,592 | B2 * | 10/2013 | Daudet et al. | 52/489.1 |
| 2002/0020138 | A1 | 2/2002 | Walker et al. | |
| 2002/0029538 | A1 | 3/2002 | Webb | |
| 2002/0046534 | A1 | 4/2002 | Heinly | |
| 2002/0069606 | A1 | 6/2002 | Gosselin et al. | |
| 2002/0144484 | A1 | 10/2002 | Vrana | |
| 2003/0014934 | A1 | 1/2003 | Bodnar | |
| 2003/0014935 | A1 | 1/2003 | Bodnar | |
| 2003/0061780 | A1 | 4/2003 | Masterson | |
| 2003/0084637 | A1 | 5/2003 | Daudet | |
| 2005/0102962 | A1 | 5/2005 | McInerney et al. | |
| 2005/0144892 | A1 | 7/2005 | Strickland et al. | |
| 2006/0010809 | A1 * | 1/2006 | Lafreniere | 52/489.1 |
| 2009/0193750 | A1 * | 8/2009 | Klima | 52/712 |

FOREIGN PATENT DOCUMENTS

| | | |
|---|---|---|
| AU | 543398 | 1/1985 |
| AU | 14733/97 | 2/1997 |
| AU | 199952660 | 10/1999 |
| AU | 762835 | 7/2003 |
| AU | 2004100666 | 8/2004 |
| CA | 900687 | 5/1972 |
| CA | 1172463 | 8/1984 |
| CA | 2092809 | 11/2001 |
| CA | 2412726 | 11/2009 |
| CA | 2455071 | 11/2011 |
| GB | 668485 | 3/1952 |
| GB | 1447055 | 8/1976 |
| GB | 2340141 | 2/2000 |
| JP | 8338103 | 12/1996 |
| WO | 02/01016 | 1/2002 |
| WO | 03/057931 | 7/2003 |
| WO | 2005/042869 | 5/2005 |

OTHER PUBLICATIONS

Ortech Industries PTY Ltd., Easibeams Steel Sections [pamphlet] (no date).

International Search Report for PCT/CA2010/001405, mailed Jan. 27, 2011.

* cited by examiner

ADJUSTABLE FLOOR TO WALL CONNECTORS FOR USE WITH BOTTOM CHORD AND WEB BEARING JOISTS

CROSS REFERENCE TO RELATED APPLICATIONS

This patent application is a National Phase application claiming the benefit of PCT/CA2009/001247 filed on Sep. 8, 2009, in English, entitled ADJUSTABLE FLOOR TO WALL CONNECTORS FOR USE WITH BOTTOM CHORD AND WEB BEARING JOISTS; which further claims the priority benefit from, U.S. Provisional Patent Application Ser. No. 61/136,476 filed on Sep. 8, 2008, both of which are incorporated herein by reference in their entirety.

FIELD OF THE INVENTION

This invention relates to structural members and in particular adjustable connections for use with structural members made from light steel.

BACKGROUND OF THE INVENTION

The light steel framing market has been improving its floor and wall system products significantly during the past several years. Floor and wall systems have improved to provide better structural performance that allow for simplified installation and provisions for follow up trades. Light Steel Framed walls are sensitive to point loads caused by floor joists, so the connection between the floor system and the wall system is an area where designers often coordinate floor joists to align with the wall studs to accommodate the floor joist end reactions. Coordinating the joists with the studs causes an added complexity for drawing and assembling a structure. Alternatively there are many special shapes that are typically expensive to supply or expensive to install that provide distribution of high floor joist end reactions by distributing the load to multiple studs. A load distribution element allows a designer to place joists between the wall studs so that the joists do not have to be coordinated and located only at wall studs.

Given the provision of structurally sound methods for distributing loads from the floor joists to the walls, to be viable it is desirable that the solution meet the requirements incumbent of a complete building system such as acoustic rating, fire stopping, and fire rating. A joist system that is intended for the framing market would be substantially bottom chord bearing or substantially web bearing in order to suit traditional framing protocols. The connection between the floor and the wall entails many design details that should be accommodated to provide a complete floor and wall framing system. The complete floor to wall connection should include as a minimum the following: (1) load distribution capability, (2) a connection that provides flexibility for onsite construction tolerances, (3) fire stopping capabilities, (4) acoustic performance capabilities, (5) provisions for rated sheathing membrane installation, (6) provisions for directly transferring floor diaphragm to the walls, and (7) ease of fabrication, shipping and installation. This invention includes various methods to provide a complete building system approach for a joist system for web and bottom chord framing.

SUMMARY OF THE INVENTION

In one aspect of the invention there is provided a joist system, comprising: a joist, including: a generally planar steel web having a web face; and at least one elongate chord member extending from the web; a connector, substantially L-shaped in cross-section, including: a connector web portion having a generally planar connector web face, a first end, and a second end; a first connector lip extending from the first end of the connector web that is generally orthogonal to the connector web face; at least one opening in the first connector lip; at least one opening in the connector web, wherein at least one of the at least one opening in the connector web and the at least one opening in the first connector lip is at least one generally elongate opening; wherein the connector is fastened to the joist via at least one fastener inserted into the at least one opening in the connector web.

In another aspect of the invention there is provided A connector for use with joist systems, comprising: a connector web portion having a generally planar connector web face, a first end, and a second end; a first connector lip extending from the first end of the connector web that is generally orthogonal to the connector web face; at least one opening in the connector lip; and at least one opening in the connector web, wherein at least one of the at least one opening in the connector web is at least one generally elongate opening.

A further understanding of the functional and advantageous aspects of the present invention can be realized by reference to the following detailed description and drawings.

BRIEF DESCRIPTION OF THE DRAWINGS

Preferred embodiments of the invention will now be described, by way of example only, with reference to the drawings, in which.

SUMMARY OF THE PRIOR ART

Figure 1A:
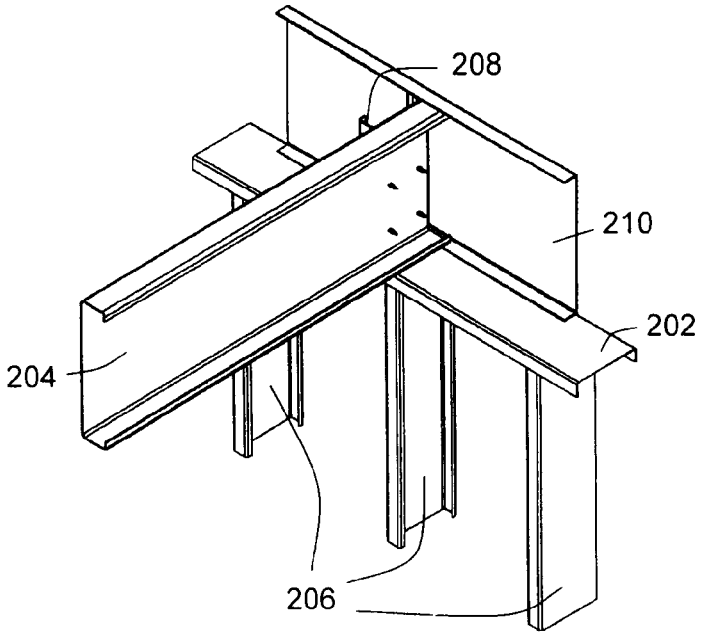
Figure 1(a) (Prior Art)
FIG. 1*a* illustrates the prior art floor joist aligned with the stud.
Figure 1B:
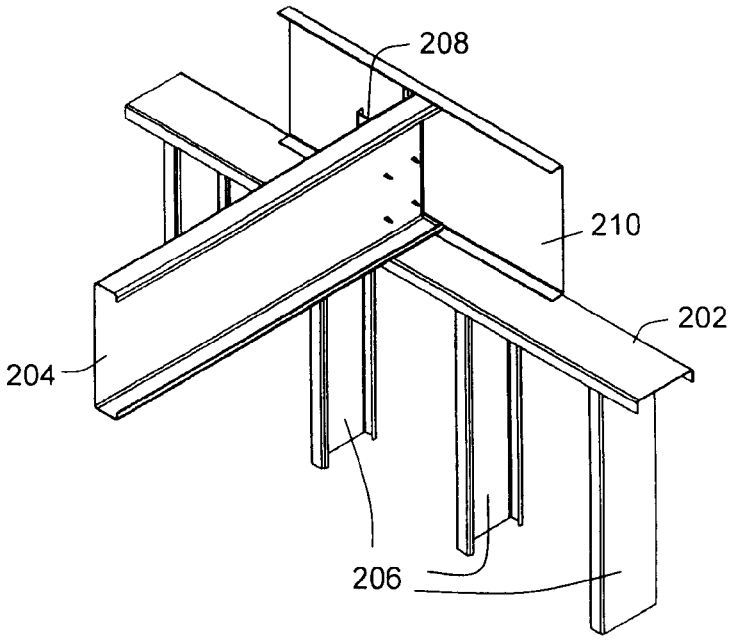
Figure 1(b) (Prior Art)
FIG. 1*b* further illustrates the prior art floor joist aligned with the stud.

Typical light steel frame (LSF) construction is based on a number of alternative sized C-Shape members. As shown in FIG. 1, wall studs are typically framed into a track section. FIG. 1(*a*) shows a floor joist 204 aligned with a stud 206 and FIG. 1(*b*) shows a floor joist 204 aligned at the midpoint between two studs 206. A problem arises using typical LSF parts because the top track section 202 on a wall cannot support typical joist end reactions. The floor joists 204 are therefore typically framed such that every joist is sufficiently aligned with a wall stud 206 (as shown in FIG. 1(*a*)). FIG. 1(*b*) illustrates a floor joist 204 positioned between two wall studs 206. Further, web crippling of the joist member 204, i.e. failure at the end of a joist due to concentrated loads from bearing, is prevented using bearing stiffeners 208. The joist is connected to the rim track 210; this can be accomplished using a C-Shape bearing stiffener 208 or by additional clips that are installed in situ to accommodate site tolerances, resulting in difficulties with installation and/or increased labor costs.

Figure 2:
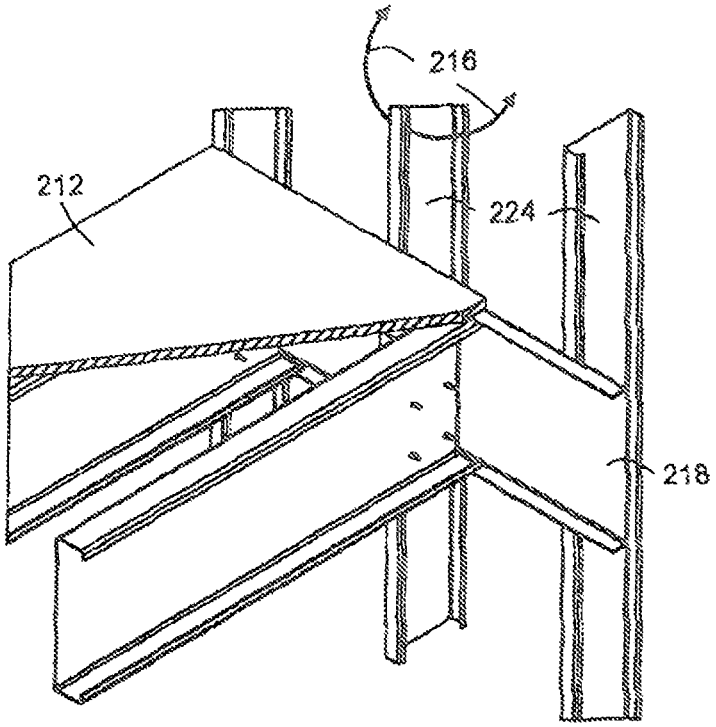
Figure 2 (Prior Art)
FIG. 2 illustrates a prior art floor joist aligned between two studs.
Figure 3:
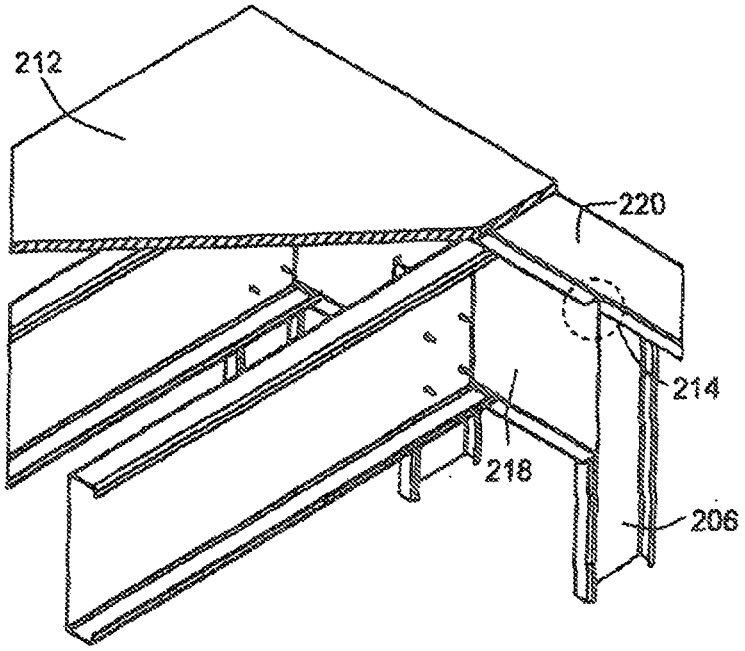
Figure 3 (Prior Art)
FIG. 3 illustrates a prior art balloon framing using track sections.

As shown in FIGS. 2 and 3, typical LSF parts can be used to provide appropriate distribution, however there are difficulties presented when trying to provide total building system coordination. A balloon framing system can be provided using a track 218 fastened to the wall studs 224 but this presents difficulty for diaphragm transfer and fire stopping installation methods.

Applying diaphragm loads at an interior point within the wall height in FIG. 2, as introduced in balloon framing, subjects the studs 224 to bending stresses 216 in their weak axis. This requires either (1) the addition of new parts to resist the diaphragm loads at the location of load application or (2) a significant increase in stud weight in order to accommodate the combined action of axial load and weak axis bending (or the combined action of axial load, weak axis bending, and strong axis bending in the case of an exterior load bearing wall). Instead, it is ideal if the diaphragm element, in this case the sheathing 212, is fastened directly to the vertical shear wall 218 without introducing additional stresses to the studs 224. As shown in FIG. 3, Using a typical LSF track section 218 results in interference 214 (material bunch-up) with the top track 220 of the supporting wall as well as the screws used to fastened the track to the studs (not shown).

Figure 4:
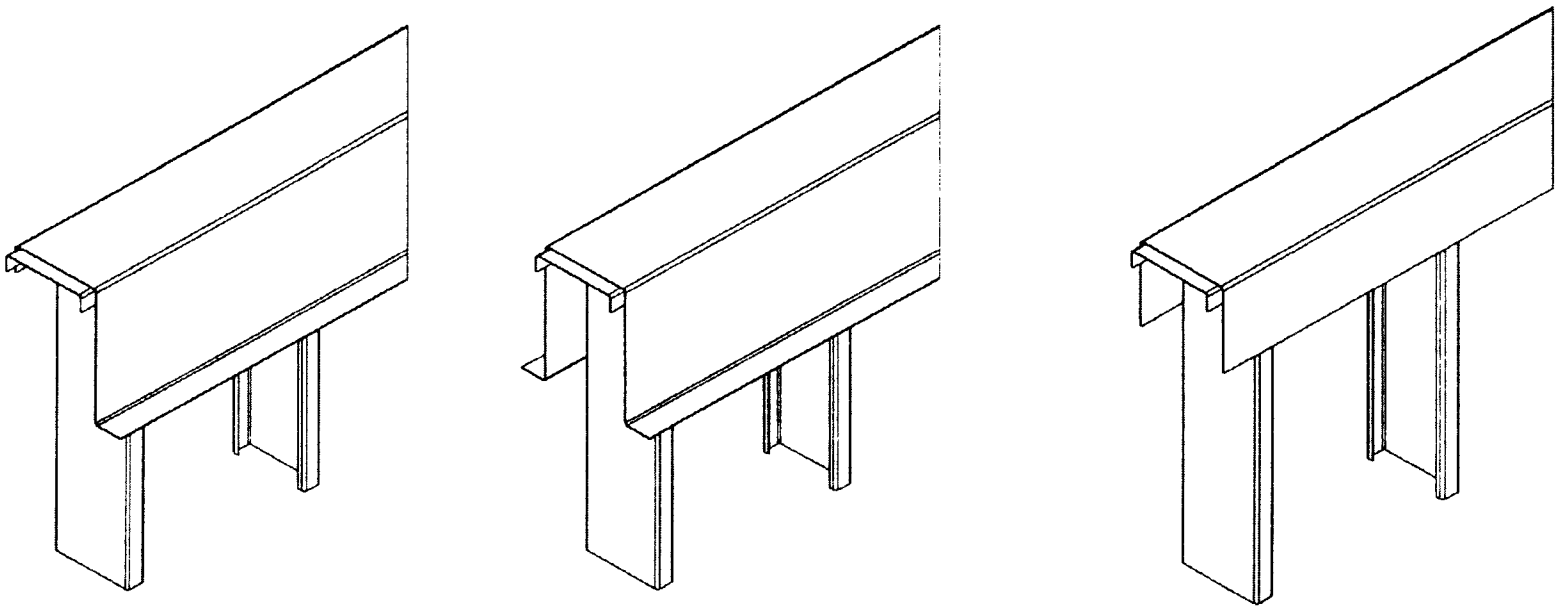
Figure 4 (Prior Art)
FIG. 4 illustrates three prior art arrangements for distribution of joist loads into wall systems.

As shown in FIG. 4, various special distribution shapes have been used but highly specialized shapes require large roll formers and present difficulty with coordinating the many alternative floor depths that are used to keep the floor system economical for alternative spans.

DETAILED DESCRIPTION OF THE INVENTION

Without limitation, the majority of the systems described herein are directed to adjustable connectors for bottom chord and web bearing joist framing. As required, embodiments of the present invention are disclosed herein. However, the disclosed embodiments are merely exemplary, and it should be understood that the invention may be embodied in many various and alternative forms.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to adjustable connectors for bottom chord and web bearing joist framing.

Figure 5:
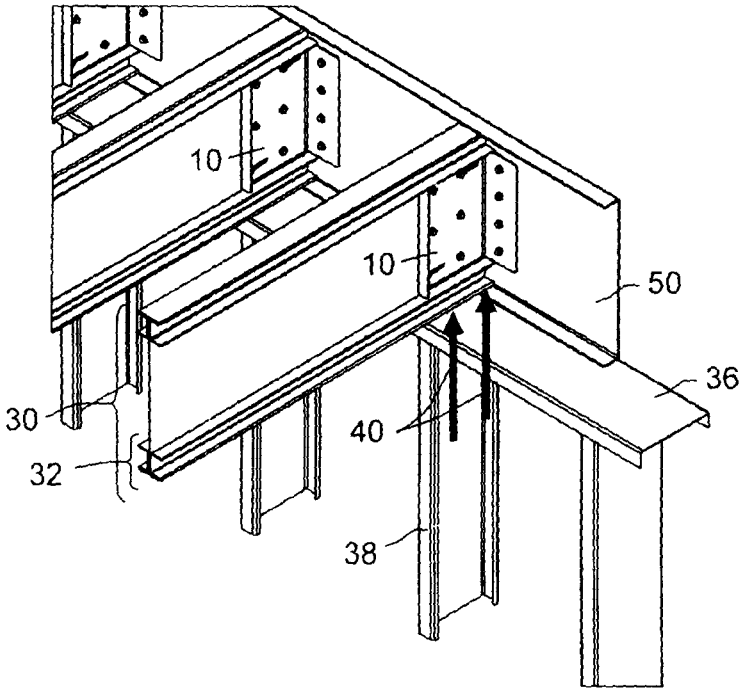
FIG. 5 is the end of joist resting on bottom chord on a wall.
Figure 6:
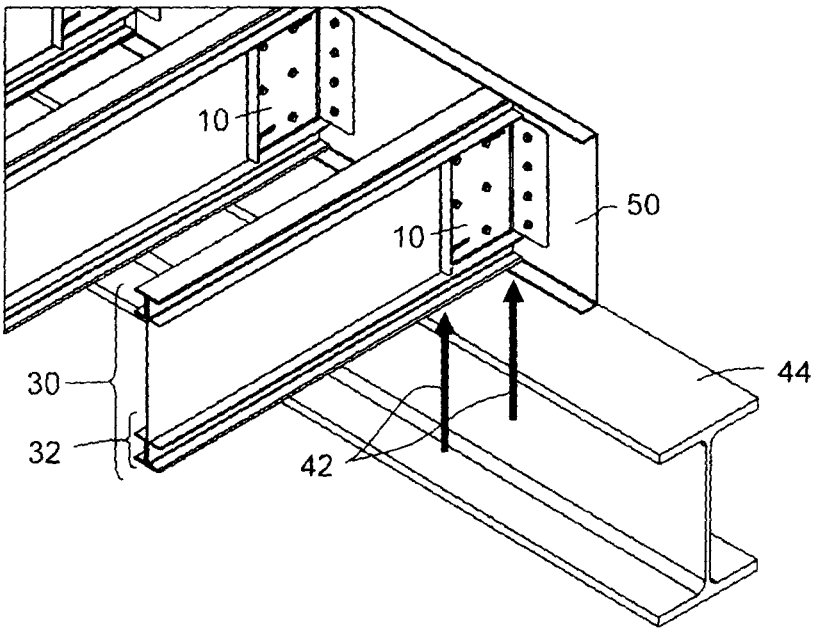
FIG. 6 is the end of joist resting on bottom chord on a beam.

To simplify the installation of bottom chord weight-bearing joists in order to suit site tolerances, this invention features an adjustable end connector 10 shown in FIGS. 5 and 6. Adjustment allows one to install end connectors 10 on the joists 30 prior to joist installation while retaining the ability to adjust the joist length when installation takes place.

FIG. 5 shows the end of a joist 30 resting on the bottom chord 32 on the top track section 36 of a wall. FIG. 6 shows the end of the joist 30 resting on the bottom chord 32 on a beam 44. Joists 30 are connected to rim track 50 via connectors 10. Forces 40 and 42 are illustrative reactions supporting the end of the bottom chord 32 of joist 30.

Figure 7:
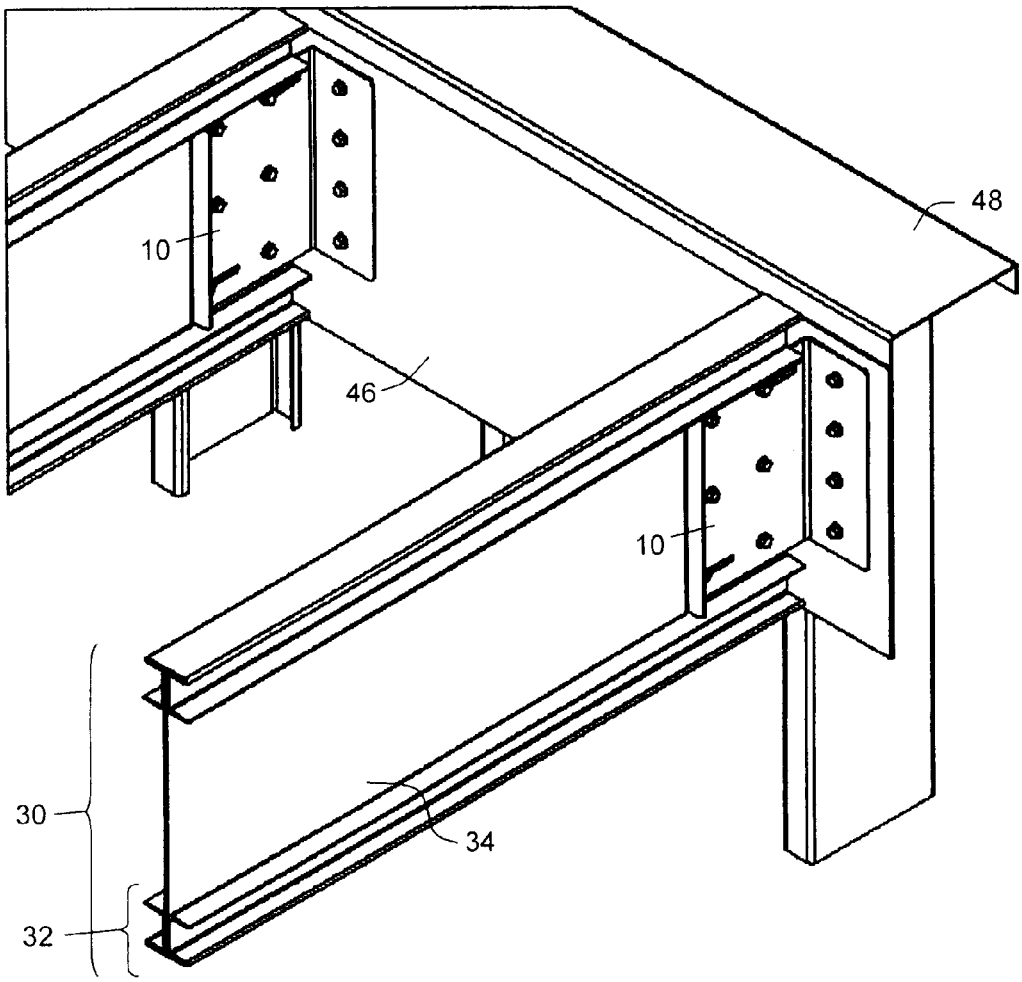
FIG. 7 is a web of joist connected to flat plate distribution member.

While FIGS. 5 and 6 show a joist 30 bearing its load via bottom chord 32, FIG. 7 shows a joist 30 bearing the load via web 34. To obtain maximum efficiency of a stick framed structure, it is desirable that a method for distribution be such that all matters related to the building system are incorporated. A flat plate system has been invented to satisfy the numerous requirements of a total building system and it is used in conjunction with a web bearing joist. The substantially flat distribution member 46 along with its accessories provides distribution of axial loads from the floor system to the wall. One can add angle 86 or special other shape accessories to help to restrain the flat plate from moving in and out of plane (shown in FIGS. 12 and 13). The special angle 86 or U shapes 86 shown in the sketches provide simple and cost effective methods for installing the rated membrane systems such as gypsum or non-combustible boards that are typically employed with ceiling systems for fire and acoustic ratings. The flat plate 46 can be extended below the floor system to provide a solid and continuous support for the vertical wall rated membrane system.

Figure 8:
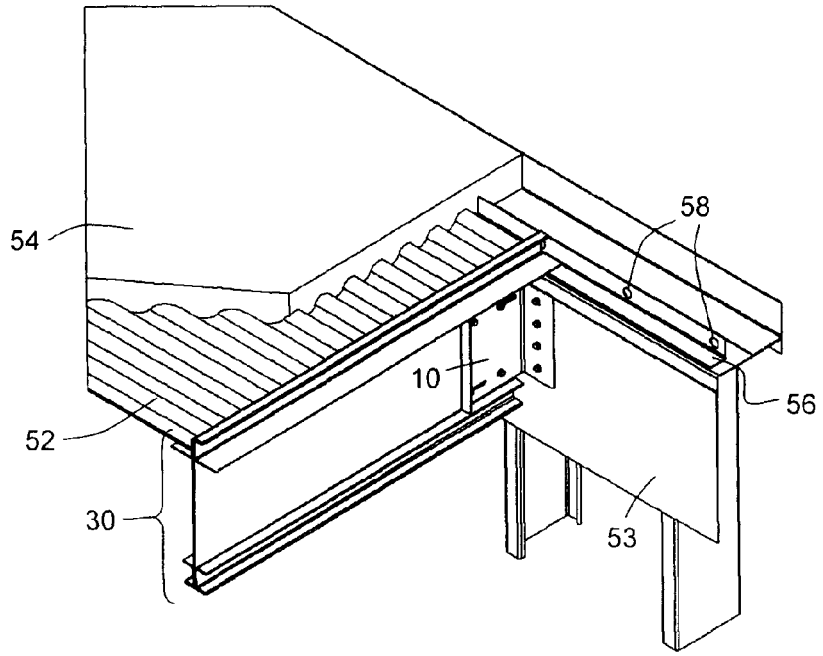
FIG. 8 is a joist framed to a wall via flat plate distribution member from one side.
Figure 9:
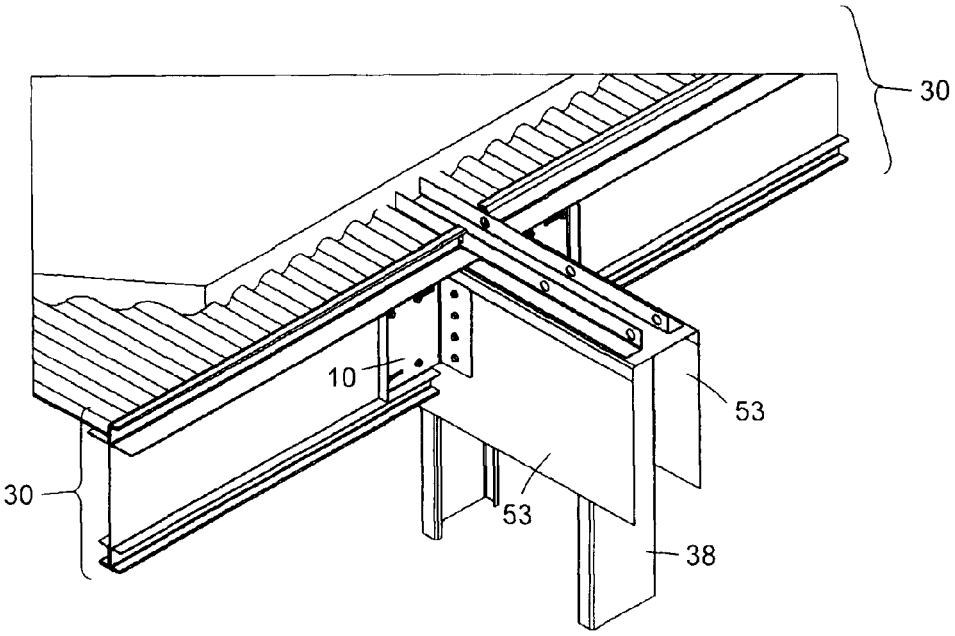
FIG. 9 is a joist framed to a wall from two sides.

As shown in FIGS. 8 and 9, a further embodiment of the present invention is a web bearing joist 30 with a top chord extension 52. This provides a safe and easy way to drop in place and safely install floor joists on a stick framed wall system. The top chord extension 52 provides an ideal solution for coordinating a concrete floor diaphragm system with a framed wall. An angle 56 can be placed under the end of the top chord where it bears on the wall, helping avoid creating a point load that will overload the wall during construction phase when concrete 54 is being poured into place. The angle 56, when properly sized, including holes 58 to create shear bond capacity, provides a passive distribution beam for the concrete floor bearing on the wall. FIG. 9 shows similar joists 30 framed from both sides of studs 38. The adjustable connector 10 fastens joists 30 to the flat distribution member 53 in FIG. 8 and the joist 30 to the flat distribution member 53 in FIG. 9.

Figure 10:
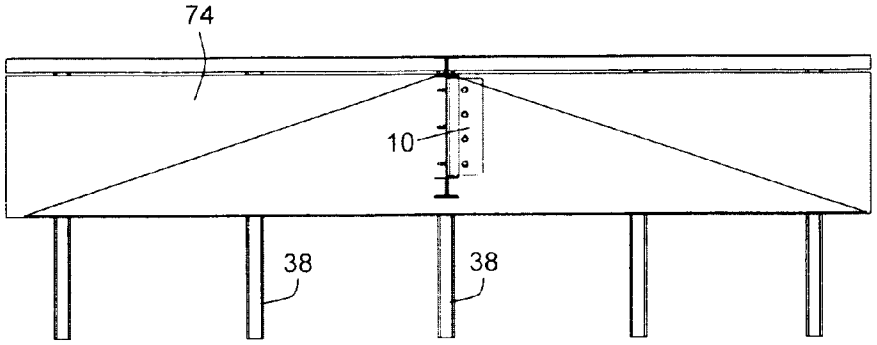
FIG. 10 is a floor joist attached to a flat plate distribution member, aligned with a stud.
Figure 11:
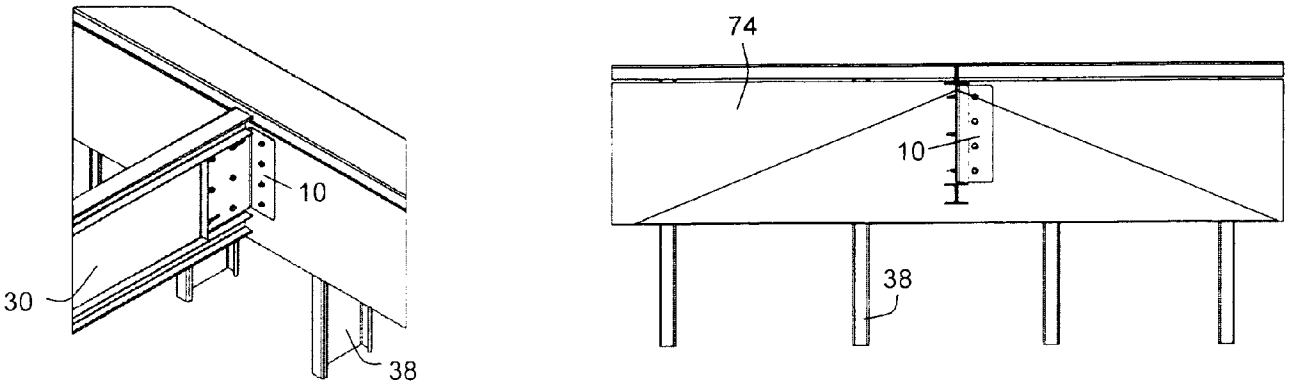
FIG. 11 is a floor joist attached to a flat plate distribution member, aligned between two studs.

As shown in FIGS. 10 and 11, the flat plate distribution member 74 allows one to design a floor system without having to align the end reactions with the wall studs, in an economical and technically superior manner. A flat plate member 74 is fastened to wall studs 38 and then floor joists 30 with connectors are fastened to the flat plate. FIG. 10 shows a floor joist 30 aligned coplanar to a stud 38 and FIG. 11 shows a floor joist 30 aligned in-between two studs 38.

Figure 12:
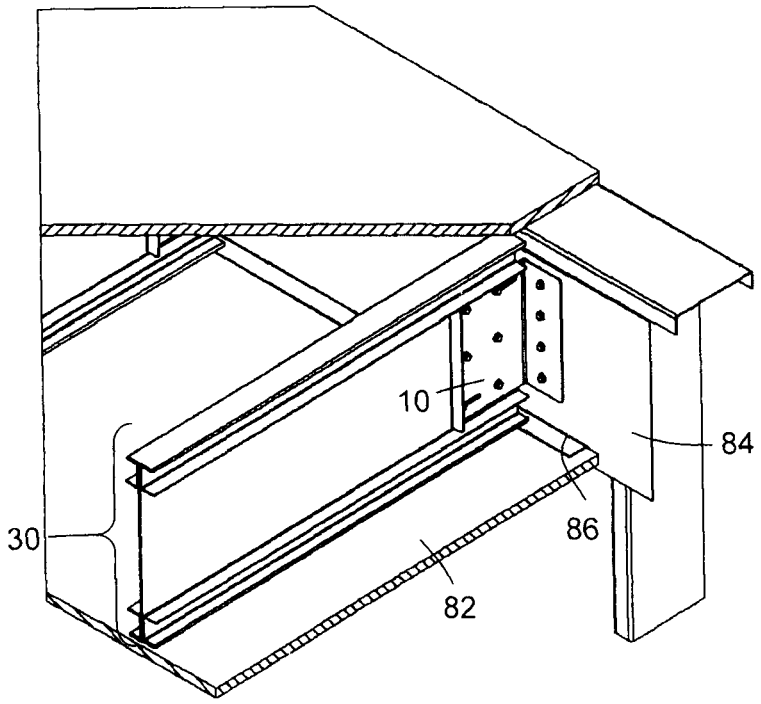
FIG. 12 is a floor joist attached to a flat plate distribution member and a planar gypsum board attached via an angle member with leg down.
Figure 13:
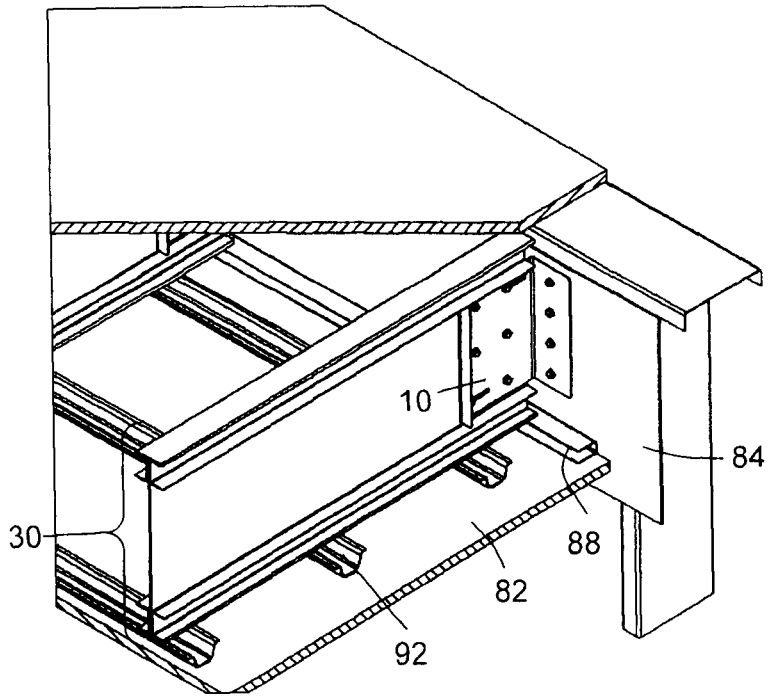
FIG. 13 is a floor joist attached to a flat plate distribution member and a planar gypsum board attached via a U-shaped member.

As shown in FIGS. 12 and 13, an angle 86 or a U shaped member 88 can be fastened to the lower portion of the flat plate 84 to support joists 30 during erection. Fastening and connection of the latter components is done via screws, welds, nails, clinching or other means. The plate is stiffened by the angle 86 or U shaped member 88 connected to the bottom and the floor system sheathing or concrete slab floor provide stability to the top. Compartmentalizing this area also allows one to provide seamless fire stopping and acoustic treatments to this critical area. In FIG. 12, the joists 30 have gypsum board 82 which is connected to the flat plate 84 via angles 86. The angle 86 is placed to provide temporary support for the joists 30 during construction and are used to provide a continuous support edge for fastening the edge of the gypsum board. In FIG. 13, hat channels 92 hang below and are attached to the underside of joists 30. The U shaped member 88 allows the gypsum board to be attached continuously along its edge and provides a temporary support for the joists 30 during construction.

Figure 14:
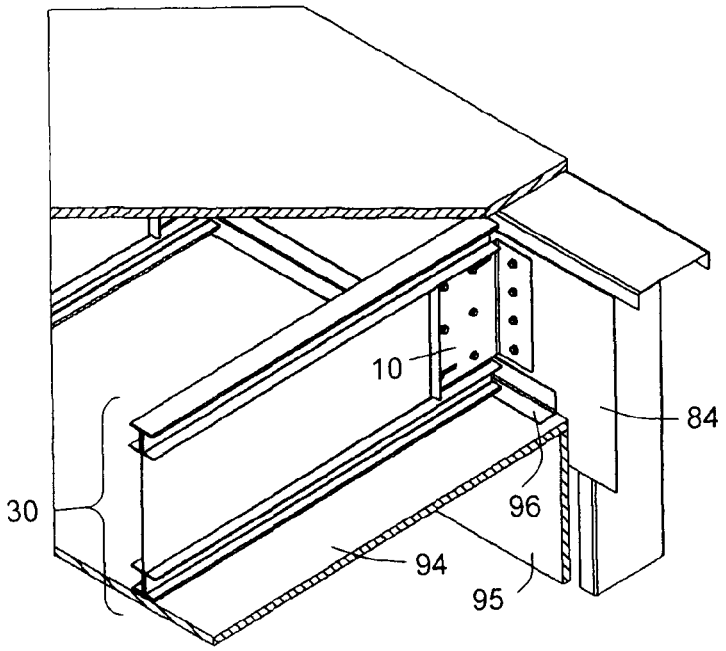
FIG. 14 is FIG. 12 with an additional wall board.
Figure 15:
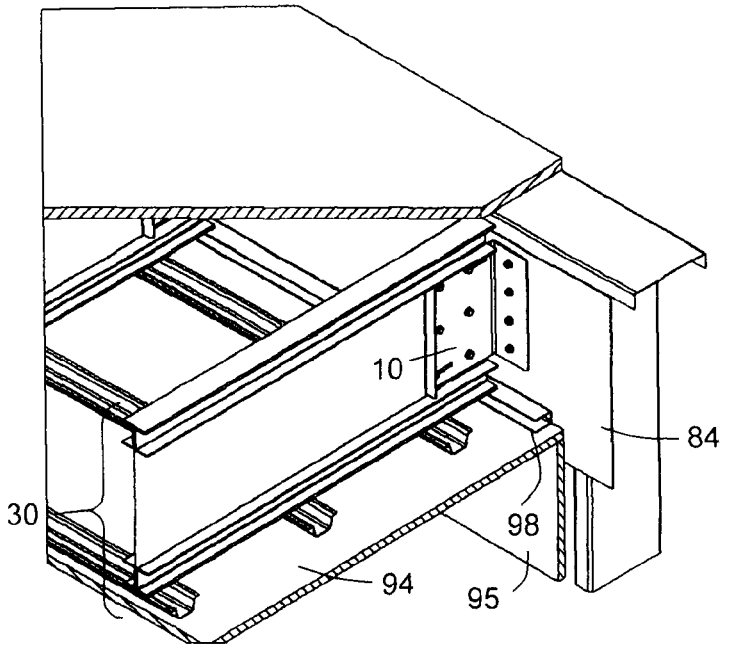
FIG. 15 is FIG. 13 with an additional wall board.

This invention provides for the continuous support of the ceiling gypsum and wall gypsum as shown in the two embodiments in FIGS. 14 and 15. With the addition of an angle 96 or U shaped member 98 at the bottom of the flat plate, this system provides a method to compartmentalize the area between the joists 30 and the area between the underside of floor and the rated membrane 94 on the ceiling system. The angle 96 or U shaped member 98 combined with the flat plate 84 collectively provide a convenient continuous surface to support the rated membrane 94. The flat plate 84, when extended slightly below the floor system, provides a continuous surface to terminate and fasten the rated membrane system 95 for the wall. The rated membrane system 95 may be a gypsum or any non-combustible board.

Figure 16:
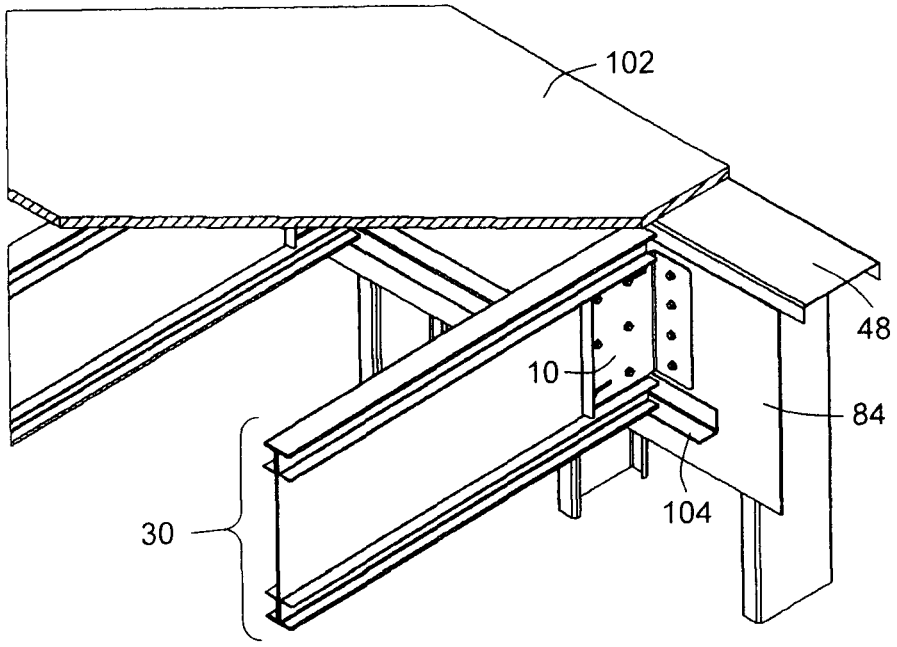
FIG. 16 is a joist framed to a wall via flat plate distribution member with floor sheathing and an angle at bottom with leg up.
Figure 17:
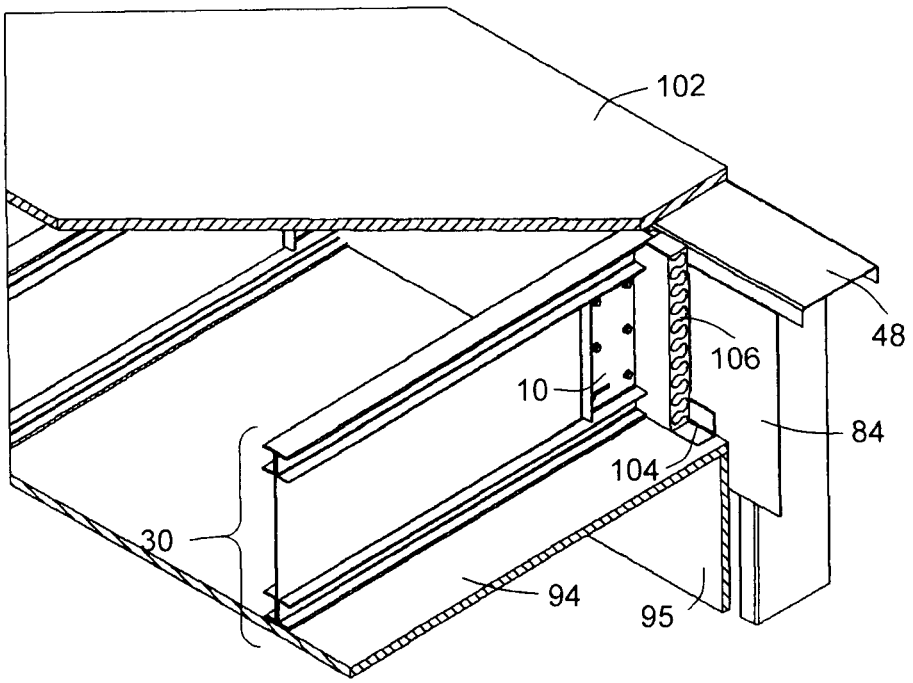
FIG. 17 is a joist framed to a wall via flat plate distribution member with floor sheathing, an angle at bottom, gypsum board and extension, and fire protection/acoustic material placed between joists.

FIGS. 16 and 17 illustrate two embodiments incorporating accessories for fire stopping and acoustic considerations. In these embodiments, the floor sheathing 102 restrains the joist 30 and wall track 48 from horizontal displacement. The angle 104 restrains the joist 30 from minor horizontal displacement during assembly. The flat plate distribution member 84 extends below the joist 30 and thus provides a continuous attachment surface for the gypsum board extension 95. The angle 104 provides a setting shelf for the joists 30, and creates a confined space between joists 30 for the placement of fire stopping and acoustic rating material 106 between joists 30, and a surface for the attachment of ceiling gypsum. Material 106 is positioned by friction fit, and then fastened by screws or adhesives or other attachment methods (not shown).

When working with metal joists, it is preferable to install the connectors 10 prior to installing each joist 30. The more preassembly that can be achieved, the more costs can be reduced. The problem with pre-installing the connectors shown in the prior art, FIGS. 1 through 4, is that there is no provision for on-site tolerances that are typically experienced.

Figure 18:
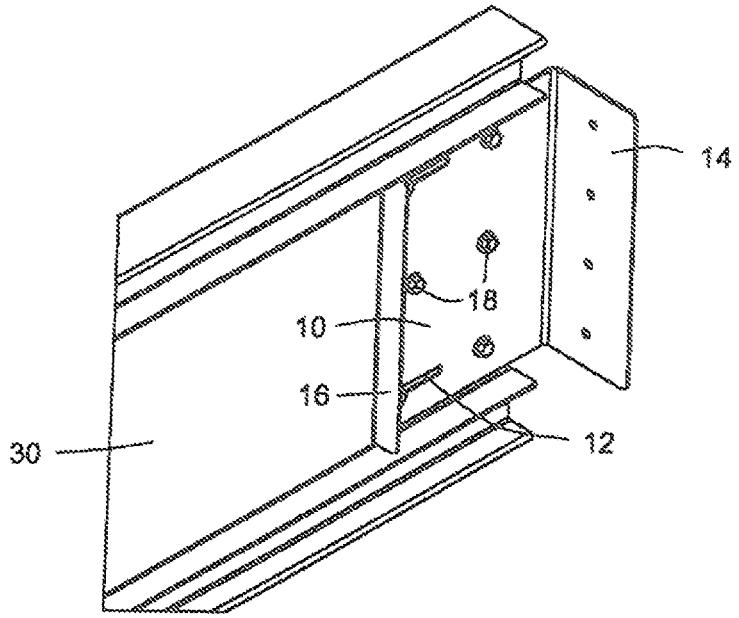
FIG. 18 is a connector attached to an iSPAN™ joist (see U.S. patent application Ser. No. 10/974,964)
Figure 19:
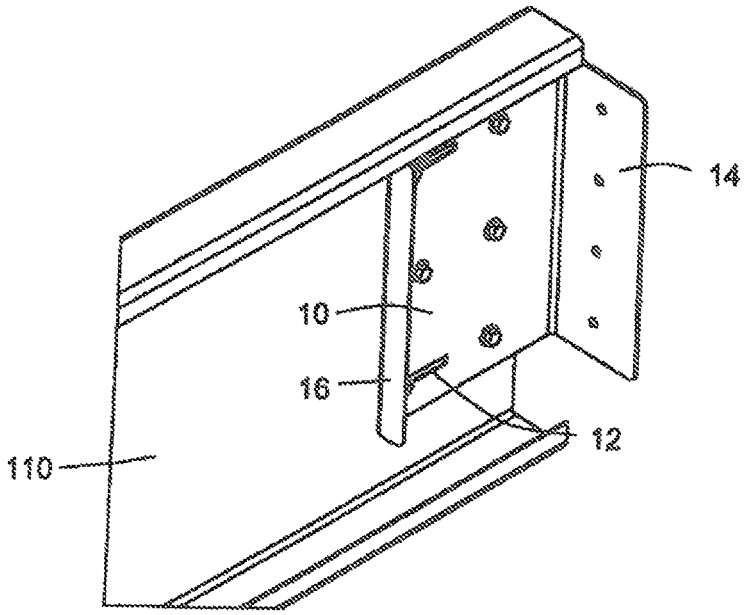
FIG. 19 is a connector attached to a C-shape joist.

The present invention proposes a connector 10 that includes slotted holes 12 in a number of locations to allow adjustment of the connector to suit site conditions as shown in FIGS. 18 and 19. Accordingly this invention provides a floor joist member of adjustable length. A substantially U shaped connector 10 is provided with a stiffening lip 16 and a connector lip 14. When fasteners 18 are installed in only the slotted holes 12, the stiffening lip 16 provides a convenient means for tapping the connector in and out. Furthermore, the connector height is selected such that typical minor slopes on roofs and floors can be accommodated by simply rotating the connector within the joist web.

Figure 20:
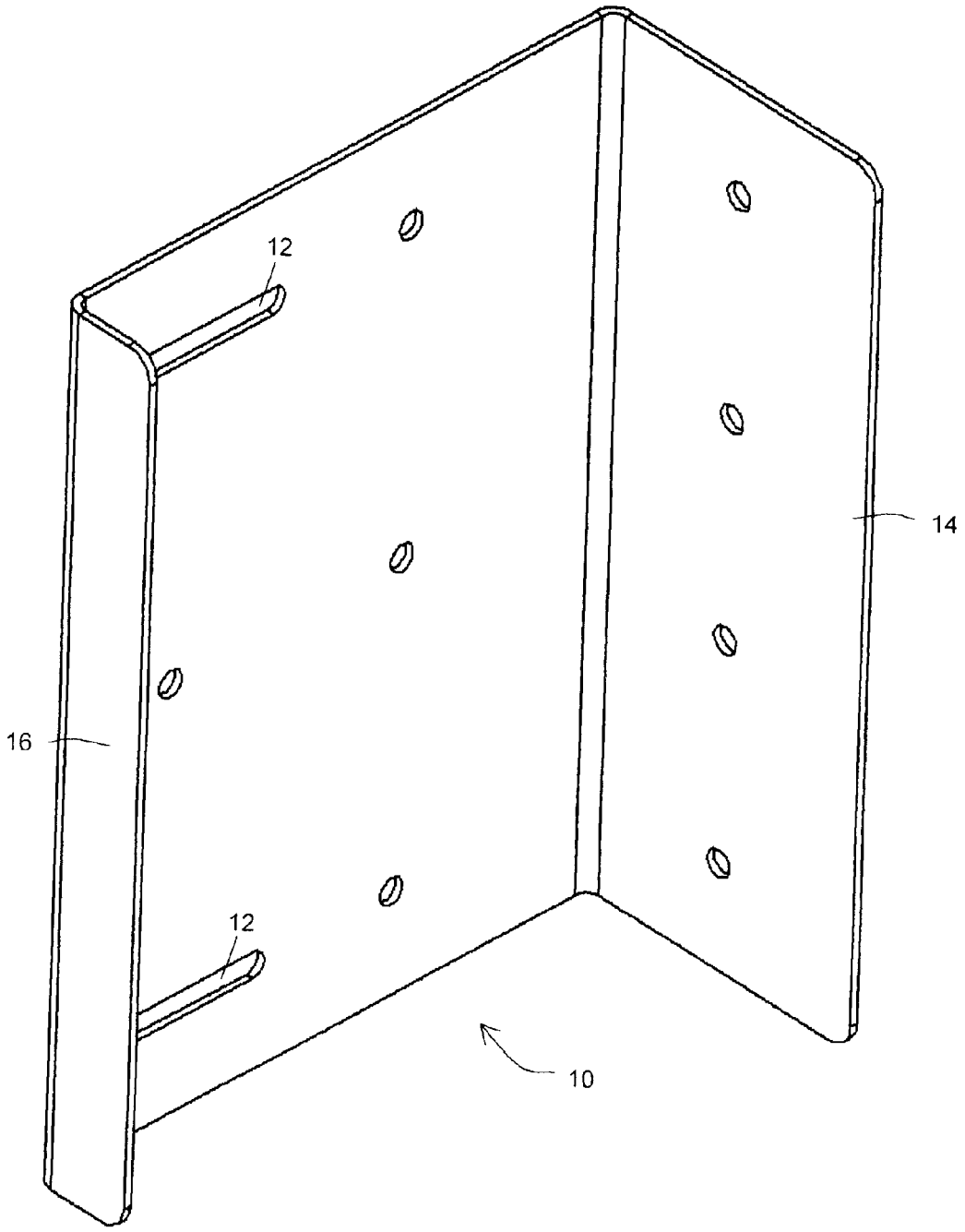
FIG. 20 is the connector.
Figure 21:
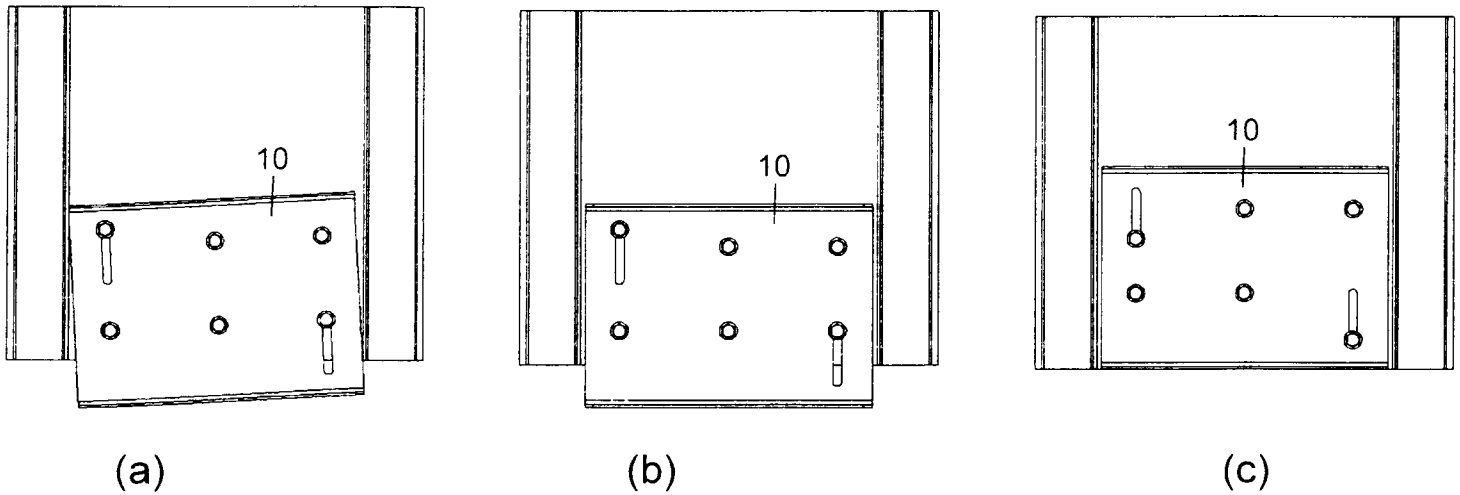
FIG. 21 illustrates adjustment capabilities of slotted connectors, wherein the connector (a) allows for sloped conditions, (b) fully extends, and (c) fully retracts.
Figure 22:
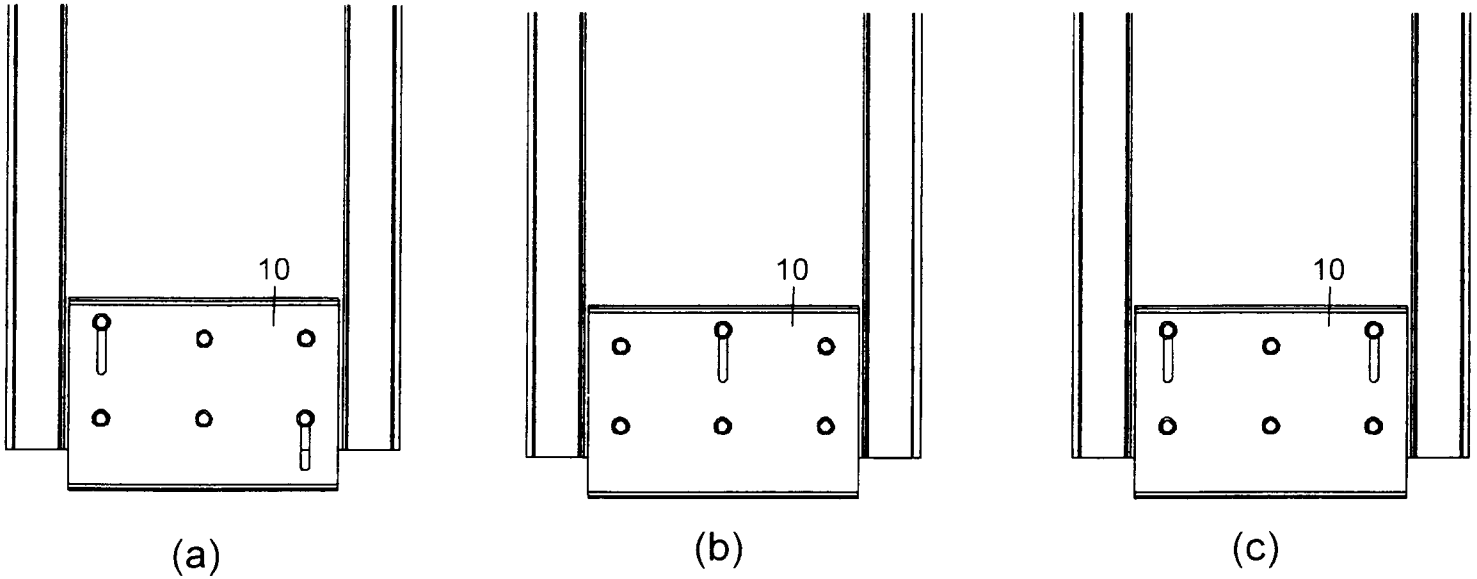
FIG. 22 illustrates alternative slotted connectors.

The connector may be used on any type of joist. FIG. 18 shows the connector 10 attached to an iSPAN™ joist 30 (see U.S. patent application Ser. No. 10/974,964) and FIG. 19 shows a C-shape joist 110. The connector 10 is isolated in FIG. 20. FIG. 21 shows alternative positions and adjustment capabilities and FIG. 22 illustrates alternative slotted connector types. FIG. 21(*a*) highlights the ability to rotate the end connector 10, thus allowing one to install the joist at an angle to the wall; FIG. 21(*b*) shows the connecter fully extended; FIG. 21(*c*) shows the connector fully retracted.

As used herein, the terms "comprises", "comprising", "includes" and "including" are to be construed as being inclusive and open ended, and not exclusive. Specifically, when used in this specification including claims, the terms "comprises", "comprising", "includes" and "including" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore, what is claimed is:

1. An adjustable length steel joist system for use in a frame structure, comprising:

a joist, including:

a generally planar steel joist web having a web face; and at least one elongate chord joist member extending from the generally planar steel joist web;

a connector connected proximate to an end of the joist, the connector made of a unitary piece of steel and including:

a connector web shaving a generally planar connector web face, a first end, and a second end opposing the first end wherein at least a portion of the connector web face is in contact with the web face of the steel joist;

a connector lip extending from the first end of the connector web that is generally orthogonal to the connector web face;

a stiffening lip extending from the second end of the connector web that is generally orthogonal to the connector web face, extending in the same direction as the connector lip and is generally parallel to the connector lip, the stiffening lip extending outwardly from the portion of the connector web face that is in contact with the web face of the steel joist;

at least one opening in the connector lip;

at least one opening in the connector web, wherein at least one of the at least one opening in the connector web is a generally elongate opening that is generally orthogonal to the connector lip and wherein the connector may be repositioned by translating and rotating the connector with respect to the at least one elongate opening; and at least one fastener inserted into at least one generally elongate opening in the connector web thereby providing a joist having an adjustable length.

2. The adjustable length steel joist system as claimed in claim 1 wherein the at least one generally elongate opening is a plurality of elongate openings, wherein the at least one opening in the connector web for fastening the joist to the connector is the plurality of elongate openings, and wherein the connector may be repositioned by translating and rotating, along the plurality of elongate openings.

3. The adjustable length steel joist system as claimed in claim 2 further including a generally planar distribution member fastened to the connector lip via at least one fastener inserted into the at least one opening in the connector lip.

4. The adjustable length steel joist system as claimed in claim 1 further including a generally planar distribution member fastened to the connector lip via at least one fastener inserted into the at least one opening in the connector lip.

5. The adjustable length steel joist system claimed in claim 4 further including an elongate stiffening member fastened along its length to the generally planar distribution member.

6. The adjustable length steel joist system claimed in claim 5 wherein the elongate stiffening member comprises:

a generally planar web portion having a web face, a first end, and a second end;

a first flange portion extending generally orthogonally from the first end of the web portion;

wherein the web of the elongate stiffening member is fastened to the distribution member.

7. The adjustable length steel joist system as claimed in claim 6 wherein the elongate stiffening member further comprises a second flange portion extending generally orthogonally from the second end of the elongate stiffening member web portion.

8. The adjustable length steel joist system as claimed in claim 7 further comprising a generally planar member attached to an underside of the joist along its length.

9. The adjustable length steel joist system as claimed in claim 6, further comprising a generally planar rated membrane attached to an underside of the joist along its length, the rated membrane being supported along its length by the first flange portion of the elongate stiffening member, the rated membrane being selected from the group consisting of: gypsum board, wall board, and non-combustible board.

10. The adjustable length steel joist system as claimed in claim 6 wherein at least one elongate chord joist member is one of: a top chord, a bottom chord, and a top and bottom chord.

11. The adjustable length steel joist system as claimed in claim 4 further comprising a generally planar member attached to an underside of the joist along its length.

12. The adjustable length steel joist system as claimed in claim 11 wherein the generally planar member is a rated membrane.

13. The adjustable length steel joist system as claimed in claim 12 wherein the rated membrane is selected from the group consisting of: gypsum board, wall board, and non-combustible board.

14. The adjustable length steel joist system as claimed in claim 11 further comprising a layer of material formed on a side surface of the generally planar distribution member.

15. The adjustable length steel joist system as claimed in claim 14 wherein the material has a property selected from the group consisting of: fire stopping, acoustic rating, and both fire stopping and acoustic rating.

16. The adjustable length steel joist system as claimed in claim 14 wherein the material is selected from the group consisting of: gypsum board, wall board, and non-combustible board.

17. The adjustable length steel joist system as claimed in claim 4 further comprising a layer of material formed on a side surface of the generally planar distribution member.

18. The adjustable length steel joist system as claimed in claim 1 wherein at least one elongate chord joist member is one of: a top chord, a bottom chord, and a top and bottom chord.

* * * * *